United States Patent [19]

Iijima et al.

[11] 4,046,346

[45] Sept. 6, 1977

[54] SLIDE MECHANISM HAVING MEANS FOR FIXING MOVABLE FRAMES

[75] Inventors: Katsuhiko Iijima, Sagamihara; Katsuhiko Yoshida, Tokyo, both of Japan

[73] Assignee: Mitsubishi Jukogyo Kabushiki Kaisha, Tokyo, Japan

[21] Appl. No.: 621,562

[22] Filed: Oct. 10, 1975

[30] Foreign Application Priority Data

Nov. 14, 1974 Japan ..... 49-131690

[51] Int. Cl.[2] ..... B61H 7/00

[52] U.S. Cl. ..... 248/298; 188/41; 212/145; 248/16

[58] Field of Search ..... 248/298, 13, 2, 16; 212/145; 280/755, 456 R, 481, 36 R, 37, 108; 188/41 X, 42; 172/272

[56] References Cited

U.S. PATENT DOCUMENTS

| | | | |
|---|---|---|---|
| 2,777,586 | 1/1957 | Boysen et al. | 280/755 X |
| 3,239,168 | 3/1966 | Wiemann et al. | 248/13 |
| 3,244,301 | 4/1966 | Vaughan | 212/145 X |
| 3,791,530 | 2/1974 | Gorl et al. | 280/755 X |
| 3,840,095 | 10/1974 | Matson | 188/42 |
| 3,891,065 | 6/1975 | Iijima | 188/41 |
| 3,953,052 | 4/1976 | Palmcrantz | 212/145 X |

*Primary Examiner*—J. Franklin Foss

*Attorney, Agent, or Firm*—Cushman, Darby & Cushman

[57] ABSTRACT

A slide mechanism comprising a movable frame mounted for generally horizontal longitudinal movement along a support frame, the movable frame comprising first and second projections which extend transversely of the support frame adjacent an upper portion and a lower portion respectively of the support frame, and a slide member releasably mounted in a first groove formed in the under side of the first projection and having a second groove arranged for sliding movement along a guide rail disposed longitudinally on the upper side of the said upper portion of the support frame, wherein one of the first and second grooves has a wedge shaped cross-section and the other groove has a semi-cylindrical cross-section, there being provided means for urging together an inclined face on the second projection and an inclined face on a downward projection of the said lower portion of the support frame which is disposed in a recess in the second projection.

11 Claims, 5 Drawing Figures

-FIG. 1-
PRIOR ART
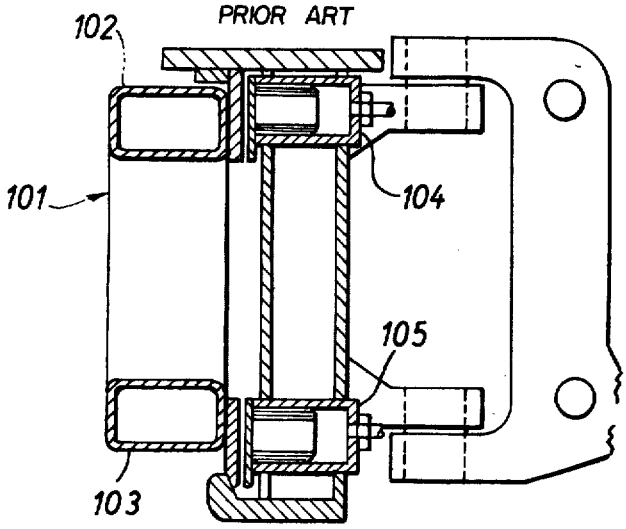
-FIG. 2-
PRIOR ART
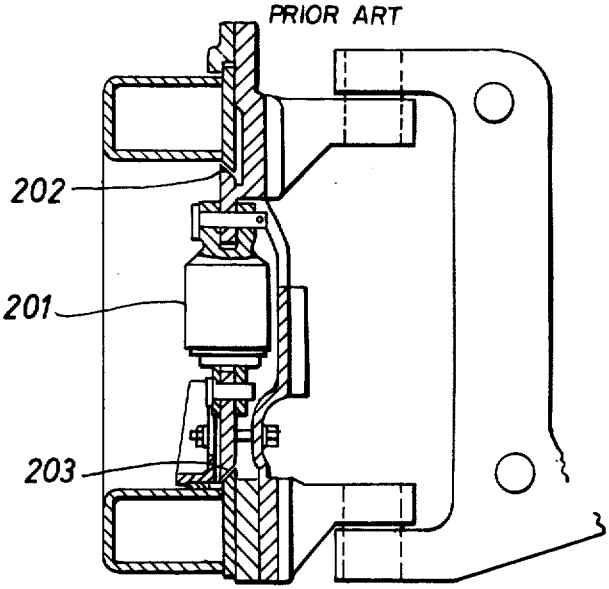

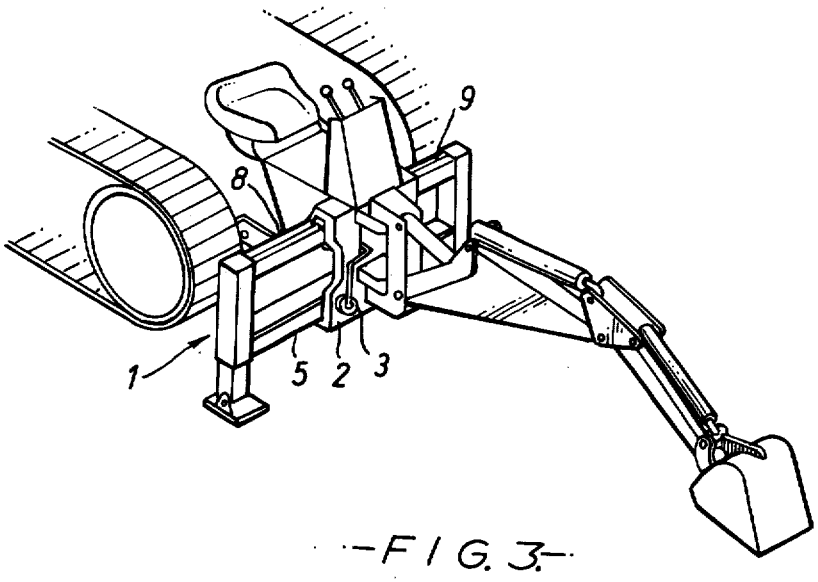
-FIG. 3-

-FIG. 4-
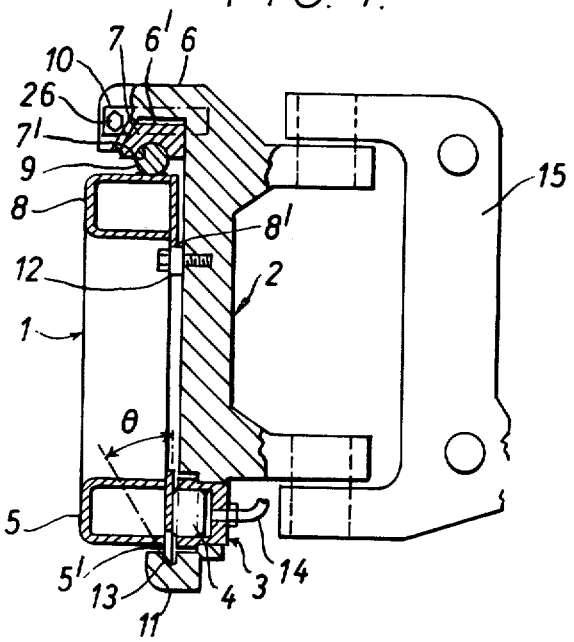
-FIG. 5-
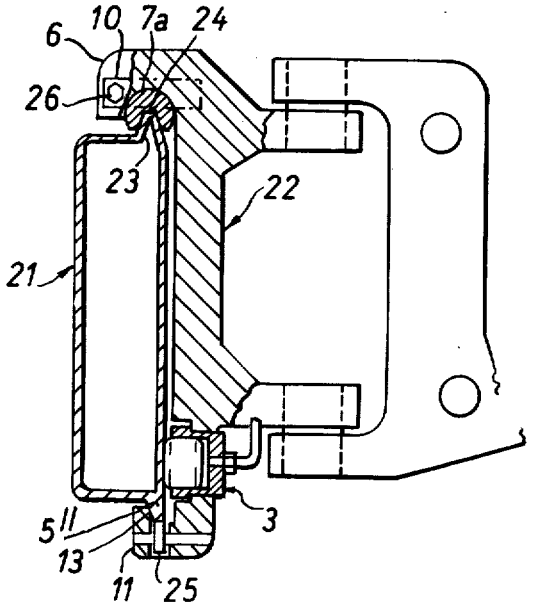

SLIDE MECHANISM HAVING MEANS FOR FIXING MOVABLE FRAMES

This invention relates to a slide mechanism having means for fixing movable frames.

Such mechanisms are found in the field of excavators, where movable frames such as backhoes, of construction machines, are slidable on support frames of vehicles. Clamping devices for fixing these movable frames to car bodies by utilizing oil pressure have recently been put into practical use.

In accordance with this invention, there is provided a slide mechanism comprising a movable frame mounted for generally horizontal longitudinal movement along a support frame, the movable frame comprising first and second projections which extend transversely of the support frame adjacent an upper portion and a lower portion respectively of the support frame, and a slide member releasably mounted in a first groove formed in the underside of the first projection and having a second groove arranged for sliding movement along a guide rail disposed longitudinally on the upper side of the said upper portion of the support frame, wherein one of the first and second grooves has a wedge shaped cross-section and the other groove has a semi-cylindrical cross-section, there being provided means for urging together an inclined face on the second projection and an inclined face on a downward projection of the said lower portion of the support frame which is disposed in a recess in the second projection.

In one embodiment the downward projection forms a rail which engages a roller mounted in the said recess for additional guiding of the movable frame.

In another embodiment the said upper portion comprises an upper beam, the underside of which is extended to form a rail which engages with a roller on the movable frame.

For a better understanding of the invention and to show how it may be carried into effect, reference will now be made, by way of example, to FIGS. 1 to 5 of the accompanying drawings, in which:

FIG. 1 shows a longitudinal section of a known apparatus in which the hydraulic cylinder of the fixing device is disposed horizontally; and FIG. 2 shows a longitudinal section of a known apparatus in which the hydraulic cylinder of the fixing device is disposed vertically;

FIG. 3 is a perspective view showing a tractor shovel including a power driven slide mechanism according to the invention, FIG. 4 is a longitudinal section of the main part of the slide mechanism used in the tractor shovel shown in FIG. 3, FIG. 5 is a longitudinal section of the main part of a slide mechanism according to another embodiment of this invention.

These known clamping devices are roughly divided into two types, which will now be described with reference to FIGS. 1 and 2 of the accompanying drawings.

In the case of a device of the former type in which an oil pressure cylinder is disposed horizontally as shown in FIG. 1, the weight of a backhoe device and the moment owing to the reaction force of excavation cause force couples on upper beam 102 and lower beam 103 of a supporting frame 101. Further, the direction of these force couples frequently turns round depending on the excavation direction and is not constant. Accordingly, a pair of oil pressure cylinders 104 and 105 is usually used and is disposed on the frame so as to counteract such force couples and prevent relaxation, and the dimensions of the apparatus cannot but be increased by provision of a pair of such oil pressure cylinders.

In the case of a device of the latter type in which an oil pressure cylinder is disposed as shown in FIG. 2, since a drag in the horizontal direction is generated at rod and head portions of an oil pressure cylinder 201 through wedges 202 and 203, the oil pressure cannot be utilized efficiently and further, since a bending force is imposed on the oil pressure cylinder per se, a problem is brought about as regards the strength of the oil pressure cylinder.

FIG. 3 is a perspective view illustrating an excavator attached to the rear portion of a tractor, by means of a slide mechanism according to this invention is applied and FIG. 4 is a view showing the main part of the fluid pressure fixing means for the mechanism, in which a supporting frame 1 is disposed across the rear of the tractor body and a moving frame 2 of the excavator is mounted for sliding movement along an upper beam 8 and a lower beam 5 which are transverse beams of the frame 1. A pair of left and right oil pressure cylinders 3 are mounted on the lower portion of the moving frame 2. The piston 4 of the oil pressure cylinder 3 is disposed horizontally so that it is urged by oil under pressure to press the front face of the lower beam 5 of the supporting frame 1 with a positive stroke.

The upper portion of the moving frame 2 is formed into a hooked projection 6 and a groove 6′ having a wedge-like section is formed on the lower face of the projection 6. Into this groove 6′, a grooved slide member 7 having a wedge-like form is freely dismountably inserted. A groove 7′ having a semicircular section is formed in the lower portion of this grooved slide member 7. A guide rail 9 of a circular section laid in the longitudinal direction on the upper face of the upper beam 8 of the supporting member 1 is engaged with said groove 7′. The grooved slide member 7 is fixed on both the side faces of the moving frame 2 by attachment bolts 26 so that it can not be moved in the sliding direction, namely in the direction parallel to the guide rail 9 of the supporting frame 1, by a lock plate 10.

The lower portion of the moving frame 2 is formed into a hook facing the wedge-like projection 6, and in this hooked portion 11, a lower projection 5′ on the front face of a lower beam 5 of the supporting frame 1 is inserted. The inner contact face of the hooked portion 11 and the contact face of the lower projection 5′ are formed into inclined faces 13, so that the inner face of the hooked portion 11 has an inclination angle $\theta$ and also the inclined contact face of the lower projection 5′ has the same inclination angle $\theta$. Referential numeral 14 denote a tube for feeding oil under pressure to the oil pressure cylinder 3, and referential numeral 15 denotes a rotary member of the excavator. A pair of rollers 12 are disposed on the back face of the moving frame 2, and a lower projection 8′ of an upper beam 8 of the supporting frame 1 is placed on the rollers 12, whereby the movement of the moving frame 2 is assisted when it is slid.

The operation of a mechanism having the above structure will now be described.

In the embodiment shown in FIG. 4, before the clamping, the moving frame 2 is in the state where it is only placed on the supporting frame 1 through the grooved slide member 7, and in this state, the moving frame 2 can freely rotate with the guide rail 9 on the upper portion of the supporting frame 1 being as the centre.

In the above-mentioned state, the hooked portion 11 can freely deviate by a distance corresponding to one stroke of the oil pressure cylinder 3 and is kept in the disengaged state. When oil under pressure is fed to the oil pressure cylinder 3 through the oil feed tube 14, the piston 4 is pressed against the lower beam 5 of the supporting frame 5 and by its reaction force, the entire excavator is rotated with the guide rail 9 as the centre and moved to the side opposite to the car body, until the inclined face 13 of the hooked portion 11 disposed on the lower part of the moving frame 2 is pressed against the inclined face of the lower beam 5 of the supporting frame 1 and by its wedging action clamping forces are generated in both the vertical and horizontal directions. The force in the horizontal direction counteracts a force couple owing to the excavating force and the weight of the excavator, and the force in the vertical direction counteracts the weight of the excavator and the excavating force.

In this embodiment, the guide rail 9 on the upper beam 8 of the supporting frame 1 has a circular section and it is engaged with the grooved slide member 7 through the groove of the member 7 having a semicircular section having the same radius as that of the rail 9, but since the upper portion of the grooved slide member 7 has a wedge-like section, it is engaged with the groove 6' of the moving frame 2 of a section having the same wedge-like configuration. Accordingly, where clamping is effected by feeding oil under pressure no small twists, deviations and shaking movements are caused in the supporting frame 1 and the moving frame 2. Further, the clamping fix can be accomplished without relaxation.

When the oil in the oil pressure cylinder 3 is released to enable the movable member to slide, the engagement in the hooked portion 11 is set free and the moving frame 2 is in the state merely placed on the supporting frame 1. When the moving frame 2 is slid, since the grooved slide member 7 is prevented from moving in the sliding direction by being fixed with the lock plate 10, it slides on the guide rail 9 with its groove of a semicircular section. At this moment, since a pair of left and right rollers 12 mounted on the moving frame 2 fall into contact with the lower projection 8' of the upper beam 8 of the supporting frame 1, the sliding is performed smoothly without an automatic stopping action being exerted.

When this excavator attached to the body of the tractor is dismounted from the supporting frame 1, the lock plate 10 mounted on the moving frame 2 is taken out and the grooved slide member 7 is dismounted, whereby the moving frame 2 is correspondingly allowed to fall and the hooked portion 11 is disengaged from the supporting frame 1, with the result that the excavator can easily be taken out from the tractor body. Mounting of the excavator can be accomplished by repeating the above procedures similarly but in a reverse order.

Another embodiment of the mechanism of this invention is illustrated in FIG. 5. This embodiment is different from the foregoing embodiment only in the following points.

Although a wedge-like slide member 7 having a groove of a semicircular section is used in the foregoing embodiment as the member interposed between the supporting frame on the side of the tractor body and the moving frame of the excavator, in this embodiment a cylindrical slide member 7*a* has a groove of a wedge-like section 24, and engaging portion of the moving frame 22 to which the slide member 7*a* is attached has a semicircular section. Also in this embodiment, a guide rail 23 mounted on the supporting frame 21 has a section of the same configuration as that of the groove 24.

A roller 25 for sliding is disposed on the hooked portion 11 of the moving frame 22, and the lower projection 5" of the supporting frame 21 is placed on this roller 25. In this embodiment, the supporting frame 21 has an integrated structure in which there is no distinction between the upper beam and the lower beam. Other structural elements and their functions are substantially the same as in the foregoing embodiment, and the same referential numerals indicate the same members as in the foregoing embodiment.

It will be appreciated that the guide 25, 5" of this embodiment can be used with the rail sections shown in FIG. 4 and vice-versa.

The above described mechanisms, are advantageous over the conventional systems in various ways. For example, although two upper and lower pairs of oil pressure cylinders are employed in the conventional apparatus of the horizontal disposition type, In these embodiments provision of an upper pair of oil pressure cylinders is omitted and good results can be obtained only by provision of a lower pair of oil pressure cylinders. Further, although bending forces are exerted on cylinders in the conventional apparatus of the vertical disposition type, occurrence of such undesired phenomenon is completely prevented in these embodiments and hence, provision of a large protective bracket is unnecessary and the entire apparatus can be made compact.

The following advantages can be attributed to the provision of a slide member that can be engaged with a groove having a wedgelike or semicircular section which is interposed between the supporting frame and moving frame. When an oil pressure is applied to the supporting frame, by the synergistic action of this groove of the grooved slide member and the inclined face of the lower hooked portion the moving frame can be fixed securely and tightly. Furthermore, dismounting of the moving frame can be accomplished very easily only by pulling out the moving frame.

What we claim is:

1. A slide mechanism comprising a movable frame mounted for generally horizontal longitudinal movement along a support frame, the movable frame comprising first and second projections which extend transversely of the support frame adjacent an upper portion and a lower portion respectively of the support frame, and a slide member releasably mounted in a first groove formed in the under side of the first projection and having a second groove arranged for sliding movement along a guide rail disposed longitudinally on the upper side of the said upper portion of the support frame, wherein one of the first and second grooves has a wedge shaped cross-section and the other groove has a semi-cylindrical cross-section, there being provided means for urging together an inclined face on the second projection and an inclined face on a downward projection of the said lower portion of the support frame which is disposed in a recess in the second projection.

2. A mechanism according to claim 1 wherein the slide member has a wedge-like form and a groove of a semi-circular cross-section, and the groove formed on the lower face of the first projection has a wedge-like cross-section.

3. A mechanism according to claim 1 wherein the slide member has a cylindrical form and a groove of a wedge-like cross-section, and the groove formed on the lower face of the first projection has a semicircular cross-section.

4. A mechanism according to claim 1 further including a roller mounted on the movable frame for guiding engagement with a rail on the support frame.

5. A mechanism according to claim 4 wherein the downward projection forms the said rail and the roller is mounted in the recess in the second projection.

6. A mechanism according to claim 4 wherein the upper portion of the support member comprises an upper beam the underside of which forms the said rail.

7. A mechanism according to claim 1 wherein the said means for urging together comprises a hydraulic cylinder.

8. A slide mechanism as in claim 1 wherein the upper and lower portions of said support frame respectively comprise vertically spaced transversely extending upper and lower beams fixed at each end to a vertical frame member, said means for urging together includes at least a hydraulic cylinder positioned adjacent said second projection so as to act upon the front face of said lower beam.

9. A slide mechanism as in claim 1 wherein said support frame is an integrated structure, said means for urging together includes at least a hydraulic cylinder positioned adjacent said second projection so as to act upon the front face of said lower portion of the support frame.

10. A slide mechanism as in claim 1 wherein the angle of the inclined face on the second projection is the same as the angle of the inclined face on the downward projection.

11. A slide mechanism as in claim 7 wherein the second projection can deviate with respect to the downward projection by a distance corresponding to the stroke of the hydraulic cylinder.

* * * * *